US006194110B1

(12) United States Patent
Hsiao et al.

(10) Patent No.: US 6,194,110 B1
(45) Date of Patent: Feb. 27, 2001

(54) IMAGING MEMBERS

(75) Inventors: Cheng-Kuo Hsiao; Ah-Mee Hor; Giuseppa Baranyi, all of Mississauga; H. Bruce Goodbrand, Hamilton, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/616,145

(22) Filed: Jul. 13, 2000

(51) Int. Cl.[7] ..... G03G 5/047; G03G 5/09

(52) U.S. Cl. ..... 430/58.7; 430/58.65; 430/58.8; 430/59.1; 430/83

(58) Field of Search ..... 430/58.65, 58.7, 430/58.8, 59.1, 83

(56) References Cited

U.S. PATENT DOCUMENTS

| | | | | |
|---|---|---|---|---|
| 3,121,006 | | 2/1964 | Middleton et al. | 430/31 |
| 3,871,882 | | 3/1975 | Wiedemann | 430/58.5 |
| 3,904,407 | | 9/1975 | Regensburger et al. | 430/58.6 |
| 3,992,205 | | 11/1976 | Wiedemann | 430/57.2 |
| 4,081,274 | | 3/1978 | Horgan | 430/58.8 |
| 4,115,116 | | 9/1978 | Stolka et al. | 430/58.8 |
| 4,233,384 | | 11/1980 | Turner et al. | 430/58.75 |
| 4,265,990 | | 5/1981 | Stolka et al. | 430/58.8 |
| 4,297,424 | | 10/1981 | Hewitt | 430/57.8 |
| 4,299,897 | | 11/1981 | Stolka et al. | 430/58.8 |
| 4,304,829 | | 12/1981 | Limburg et al. | 430/58.3 |
| 4,306,008 | | 12/1981 | Pai et al. | 430/58.8 |
| 4,419,427 | | 12/1983 | Graser et al. | 430/58.6 |
| 4,429,029 | | 1/1984 | Hoffmann et al. | 430/58.6 |
| 4,501,906 | | 2/1985 | Spietschka et al. | 549/232 |
| 4,555,463 | | 11/1985 | Hor et al. | 430/57.3 |
| 4,587,189 | | 5/1986 | Hor et al. | 430/58.8 |
| 4,609,605 | | 9/1986 | Lees et al. | 430/58.1 |
| 4,668,600 | * | 5/1987 | Lingnau | 430/83 |
| 4,709,029 | | 11/1987 | Spietschka et al. | 544/125 |
| 4,714,666 | | 12/1987 | Wiedemann et al. | 430/59.1 |
| 4,921,773 | | 5/1990 | Melnyk et al. | 430/132 |
| 4,937,164 | | 6/1990 | Duff et al. | 430/58.8 |
| 4,968,571 | | 11/1990 | Gruenbaum et al. | 430/59.1 |
| 5,019,473 | | 5/1991 | Nguyen et al. | 430/59.1 |
| 5,139,910 | | 8/1992 | Law et al. | 430/58.8 |
| 5,225,307 | | 7/1993 | Hor et al. | 430/136 |
| 5,320,921 | * | 6/1994 | Oshiba et al. | 430/83 |
| 5,645,965 | | 7/1997 | Duff et al. | 430/58.8 |
| 6,051,351 | * | 4/2000 | Hsaio et al. | 430/59.1 |

* cited by examiner

*Primary Examiner*—Roland Martin
(74) *Attorney, Agent, or Firm*—E. O. Palallo

(57) ABSTRACT

A photoconductive imaging member containing a photogenerating layer comprised of a mixture of perylenes, wherein the mixture comprises, for example, (1) 1,3-bis(n-pentylimidoperyleneimido) propane (Formula A), 1,3-bis(2-methylbutylimido peryleneimido)propane (Formula B) and 1-(n-pentylimidoperyleneimido)-3-(2-methylbutylimidoperyleneimido)-propane (Formula C), and (2) an electron acceptor component Formula A 1,3-bis(n-pentylimidoperyleneimido)propane

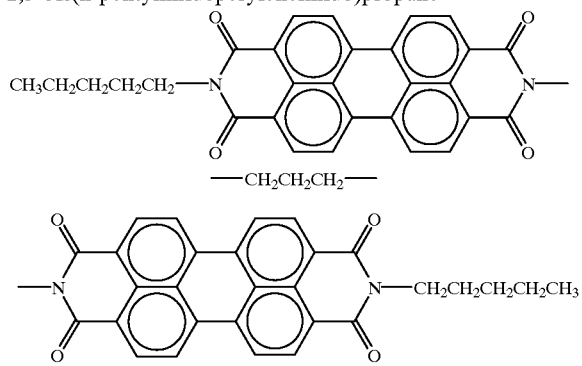

Formula B 1,3-bis(2-methylbutylimidoperyleneimido)propane

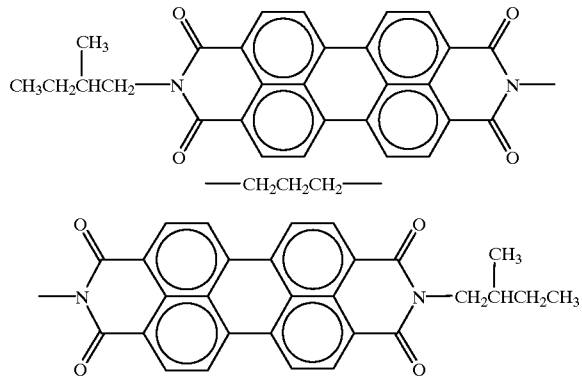

Formula C 1-(n-pentylimidoperyleneimido)-3-(2-methylbutylimidoperyleneimido)propane

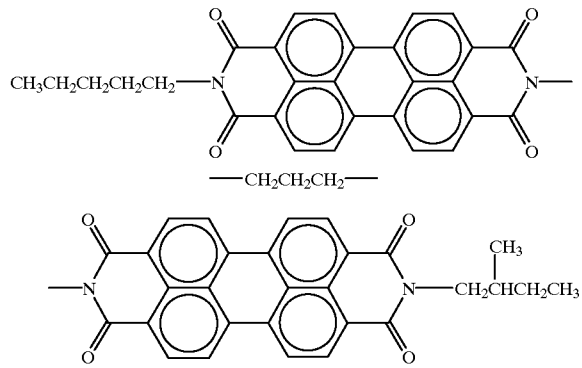

31 Claims, No Drawings

IMAGING MEMBERS

PENDING APPLICATIONS AND PATENTS

Illustrated in copending application U.S. Serial No. (not yet assigned—D/A0629), filed concurrently herewith, the disclosure of which is totally incorporated herein by reference, is a photoconductive imaging member comprised of a photogenerating layer comprised of a mixture of perylenes, wherein said mixture comprises (1) 1,3-bis(n-pentylimidoperyleneimido)propane (Formula A), 1,3-bis(2-methylbutylimido peryleneimido)propane (Formula B) and 1-(n-pentylimidoperyleneimido)-3-(2-methylbutylimido peryleneimido)-propane (Formula C) and (2) an electron acceptor component polymer Formula A 1,3-bis(n-pentylimidoperyleneimido)propane

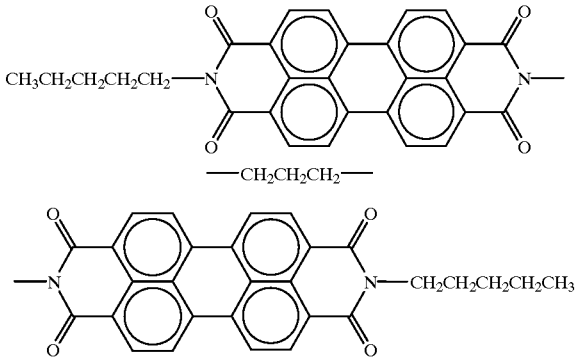

Formula B 1,3-bis(2-methylbutylimidoperyleneimido)propane

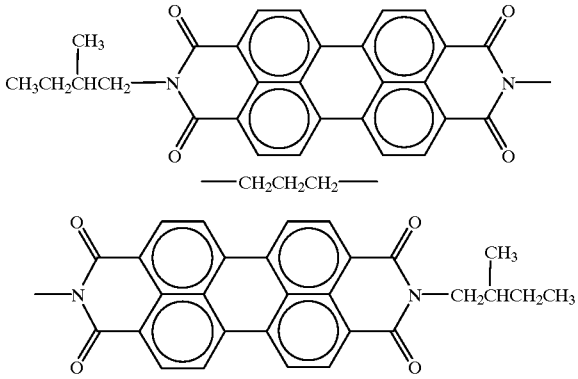

Formula C 1-(n-pentylimidoperyleneimido)-3-(2-methylbutylimidoperyleneimido)propane

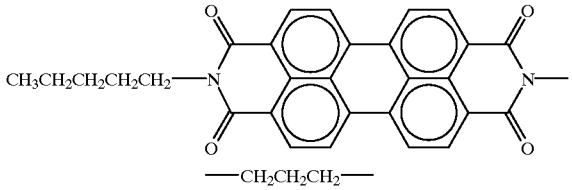

-continued

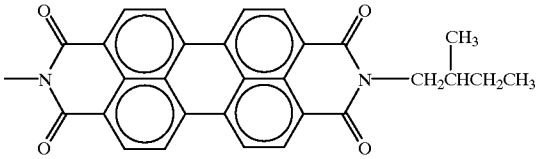

Illustrated in copending application U.S. Ser. No. 09/578,381, pending and U.S. Pat. No. 5,645,965, the disclosures of which are totally incorporated herein by reference, are perylenes and photoconductive imaging members thereof. More specifically, in U.S. Ser. No. 09/578,381, there is illustrated a photoconductive imaging member comprised of a mixture of at least two symmetrical perylene bisimide dimers of Formula 1

FORMULA 1

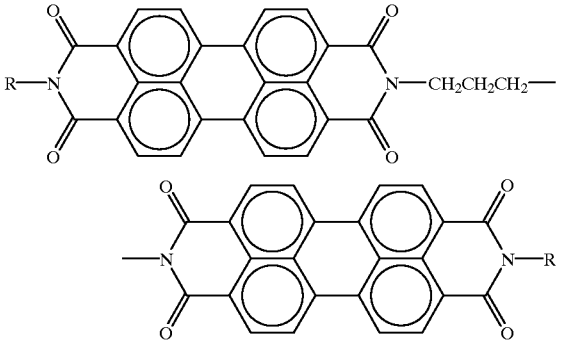

wherein R is hydrogen, alkyl, cycloalkyl, substituted alkyl, aryl, substituted aryl, aralkyl or substituted aralkyl, and at least one terminally unsymmetrical dimer of Formula 2

FORMULA 2

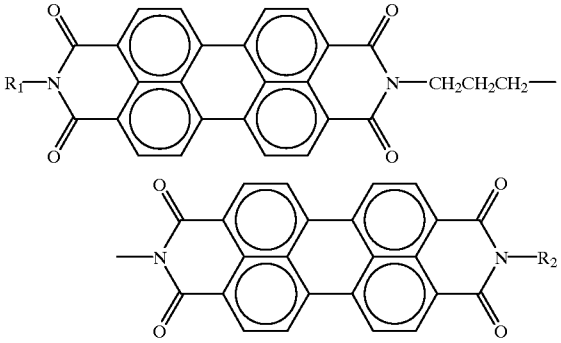

wherein $R_1$ and $R_2$ are hydrogen, alkyl, cycloalkyl, substituted alkyl, aryl, substituted aryl, aralkyl, or substituted aralkyl, and wherein $R_1$ and $R_2$ are dissimilar. Also, illustrated in U.S. Ser. No. 09/165,595, allowed the disclosure of which is totally incorporated herein by reference, is a photoconductive imaging member comprised of an unsymmetrical perylene of the formula

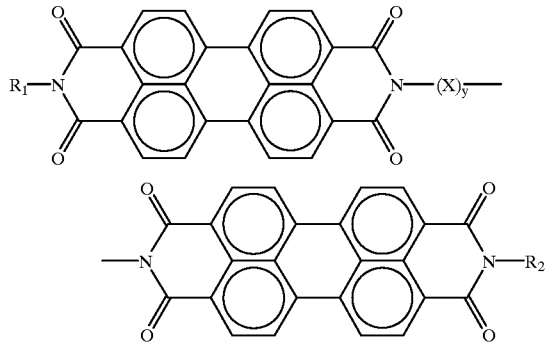

wherein each $R_1$ and $R_2$ are dissimilar and wherein said $R_1$ and $R_2$ are hydrogen, alkyl, cycloalkyl, substituted alkyl, aryl, substituted aryl, aralkyl, and substituted aralkyl, and X represents a symmetrical bridging component, and y represents the number of X components. In U.S. Ser. No. 09/579,255 pending there is disclosed a process for the preparation of perylene mixtures comprised of at least two symmetrical perylene bisamide dimers of Formula 1

FORMULA 1

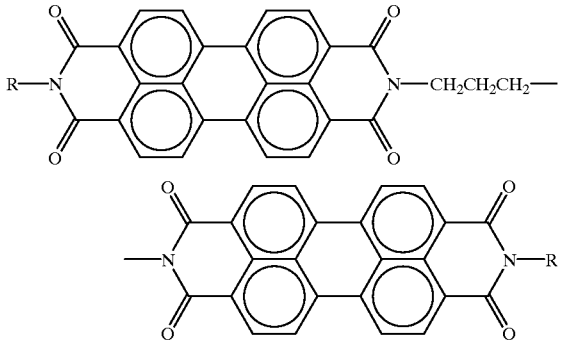

wherein R is hydrogen, alkyl, cycloalkyl, substituted alkyl, aryl, substituted aryl, aralkyl or substituted aralkyl, and at least one terminally unsymmetrical dimer of Formula 2

FORMULA 2

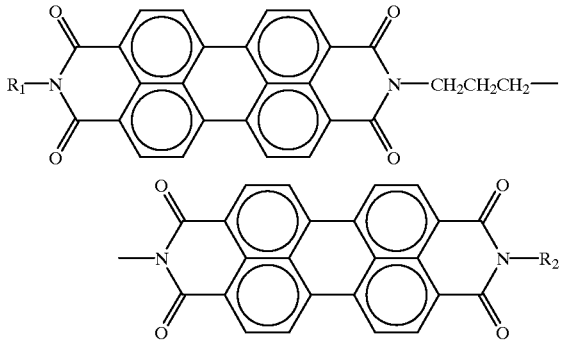

wherein $R_1$ and $R_2$ are hydrogen, alkyl, cycloalkyl, substituted alkyl, aryl, substituted aryl, aralkyl, or substituted aralkyl, and wherein $R_1$ and $R_2$ are dissimilar, which process comprises the condensation of a mixture of at least two perylene monoimide-monoanhydrides of Formula 3 with a diamine

FORMULA 3

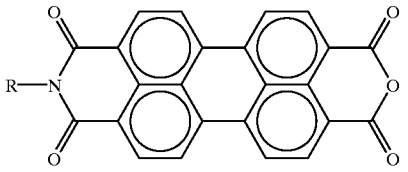

wherein R is hydrogen, alkyl, cycloalkyl, substituted alkyl, aryl, substituted aryl, aralkyl, and substituted aralkyl, with a 1,3-diaminopropane. The appropriate components and processes of the above applications and patent can be selected for the present invention in embodiments thereof.

BACKGROUND OF THE INVENTION

With the present invention in embodiments thereof, there is provided a photoconductive imaging member containing a photogenerating layer of mixed perylenes, such as those of U.S. Pat. No. 6,051,351, the disclosure of which is totally incorporated herein by reference, and which perylenes contain electron acceptors, or an electron acceptor, and which acceptor can enhance or increase the photosensitivity of the photogenerating layer by, for example, in embodiments about 40 percent, and more specifically, from about 15 to about 35 percent in embodiments.

The present invention is directed, more specifically, to photoconductive imaging members with a photogenerating perylene mixture containing three perylene dimers represented, for example, by Formulae A,B and C (535+), and an electron acceptor component. In embodiments, the weight of electron acceptor relative to the total weight of perylene dimers is, for example, about 0.1 to about 20 weight percent; and more specifically, for example, the amount of electron acceptor varies from about 0.9 percent to about 16.7 percent, and the mixed perylene dimer amount varies from about 99.1 to about 83.3 percent. For the mixed perylene dimer portion, excluding the electron acceptor, each perylene may be selected in an amount of from about 5 to about 90, and in embodiments from about 25 to about 50 weight percent. More specifically, the mixed perylene dimer can be comprised of about 25 percent of 1,3-bis(n-pentylimidoperyleneimido)propane, about 25 percent of 1,3-bis(2-methylbutylimidoperyleneimido)propane, and about 50 percent of 1-(n-pentylimido peryleneimido)-3-(2-methylbutylimido peryleneimido)propane. In the perylene mixture in embodiments, each perylene of Formulae A, B, and C can be present in an amount of from about 4 to about 80 or 90 weight percent, and the electron acceptor can be present in an amount of from about 0.1 to about 20 weight percent, and wherein the total of the perylene mixture and the electron acceptor is about 100 percent.

FORMULA A 1,3-bis(n-pentylimidoperyleneimido)propane

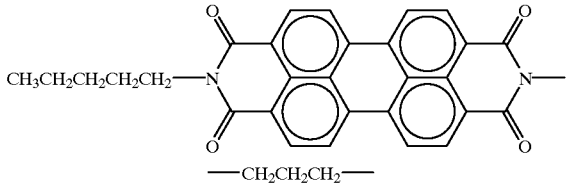

-continued

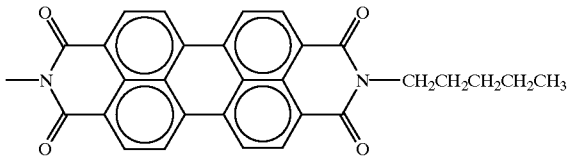

FORMULA B 1,3-bis(2-methylbutylimidoperyleneimido)propane

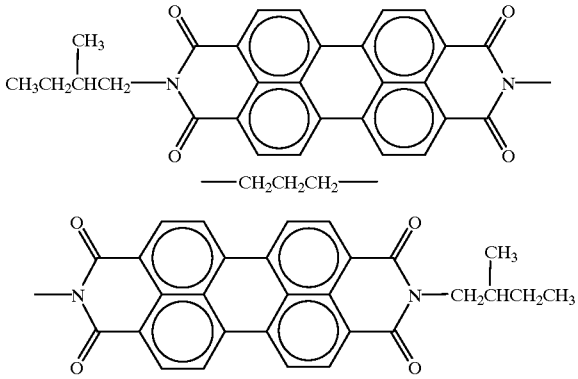

FORMULA C 1-(n-pentylimidoperyleneimido)-3-(2-methylbutylimidoperyleneimido)propane

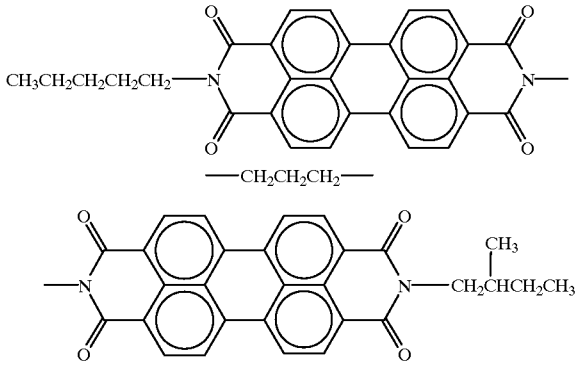

Furthermore, with the perylene dimer mixture composition components of the present invention there may be permitted larger latitudes and adjustment and design of the physical properties of the photogenerating pigment, such as increasing the photosensitivity, and improving the dispersion stability thereof. Increasing photosensitivity permits, for example, the use of light source at a reduced power rating by, for example, about 40 percent and hence a hardware cost savings. Also, dispersion stability time can be prolonged by more than about 100 percent as the dopants or electron acceptor components added can adsorb and modify the perylene pigment surface resulting in reduced aggregation of the perylene pigment particles.

Examples of electron acceptor materials include polymers and compounds, inclusive of nonpolymers, and more specifically, PMMA-BCFM polymers, carbazoles, fluorenones and fluorenylidene malonitriles. The electron acceptor component can be added to the mixed perylene dimers prior to or during the preparation of photogenerator layer. The relative weight of electron acceptor with respect to the total amount of mixed perylene dimers can vary in embodiments of from about 0.1 to about 20 weight percent, and more specifically, from about 1 to about 16 or 10 weight percent.

Specific examples of electron acceptors are 9-vinylcarbazole, 9-phenylcarbazole, 9-ethylcarbazole, 9-naphthylcarbazole, polyvinylcarbazole, (4-n-butoxycarbonyl-9-fluorenylidene)malonitrile (BCFM), 2,7-dinitro-9-fluorenylidene malonitrile, 2,4,7-trinitro-9-fluorenylidenemalonitrile, 2,4,5,7-tetranitro-9-fluorenylidene malonitrile, 2,4,7-trinitro-9-fluorenone, 4-n-butoxycarbonyl-9-fluorenone, 2-nitro-9-fluorenone, 2,7-dinitro-4-n-butoxycarbonyl-9-fluorenone, 2-t-butyl-4,5,7-trinitro-9-fluorenone, polymers thereof, especially polymers of polymethylmethacrylate (PMMA) and BCFM, and the like.

Imaging members with the photogenerating pigment perylene and electron acceptor mixture of the present invention are sensitive to wavelengths of, for example, from about 400 to about 800 nanometers, that is throughout the visible and near infrared region of the light spectrum. Also, the imaging members of the present invention generally possess broad spectral response to white light from about 400 to about 800 nanometers and stable electrical properties, such as the charging voltage and the photodischarging characteristics remaining relatively constant over long cycling times as illustrated herein.

PRIOR ART

Certain individual perylene dimers are photoconductive and can be used to form photoconductive imaging members, however, these dimers may possess certain disadvantages, such as in some instances low photosensitivity, narrow spectral response range, poorer dispersion quality and the like, which disadvantages could limit their applications as imaging members. In U.S. Pat. No. 6,051,351 there is illustrated a mixture of perylene dimers that generally exhibit an improved photosensitivity compared to the individual perylene components in the mixture. With the members of the present invention in embodiments thereof, these disadvantages can be minimized or eliminated, and increased photosensitivity can be obtainable by adding electron acceptor components.

Generally, layered photoresponsive imaging members are described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The selection of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9, 10-tetracarboxyl diimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a nonhalogenated perylene pigment photogenerating component. Both of the aforementioned patents disclose an aryl amine component as a hole transport layer.

Moreover, there are disclosed in U.S. Pat. No. 4,419,427 electrographic recording mediums with a photosemiconductive double layer comprised of a first layer containing charge carrier perylene diimide dyes, and a second layer with one or more compounds which are charge transporting materials when exposed to light, reference the disclosure in column 2, beginning at line 20.

Certain perylenes can be prepared by reacting perylene tetracarboxylic acid dianhydride with primary amines or with diamino-aryl or alkyl compounds. Their use as photoconductors is disclosed in U.S. Pat. No. 3,871,882, the disclosure of which is totally incorporated herein by reference, and U.S. Pat. No. 3,904,407, the disclosure of which is totally incorporated herein by reference. The '882 patent discloses the use of the perylene dianhydride and bisimides in general (Formula 3a, R=H, lower alkyl (C1 to C4), aryl, substituted aryl, aralkyl, a heterocyclic group or the NHR' group in which R' is phenyl, substituted phenyl or benzoyl) as vacuum evaporated thin charge generation layers (CGLs) in photoconductive devices coated with a charge transporting layer (CTL). The '407 patent, the disclosure of which is totally incorporated herein by reference, illustrates the use of bisimide compounds (Formula 3a, R=alkyl, aryl, alkylaryl, alkoxyl or halogen, or heterocyclic substituent) with preferred pigments being R=chlorophenyl or methoxyphenyl. This patent illustrates the use of certain vacuum evaporated perylene pigment or a highly loaded dispersion of pigment in a binder resin as CGL in layered photoreceptors with a CTL overcoat or, alternatively, as a single layer device in which the perylene pigment is dispersed in a charge transporting active polymer matrix. The use of a plurality of pigments, inclusive of perylenes, in vacuum evaporated CGLs is illustrated in U.S. Pat. No. 3,992,205.

U.S. Pat. No. 4,419,427 illustrates the use of highly-loaded dispersions of perylene bisimides, with bis(2,6-dichlorophenylimide) being a preferred material, in binder resins as CGL layers in devices overcoated with a charge transporting layer such as a poly(vinylcarbazole) composition. U.S. Pat. No. 4,429,029 illustrates the use of bisimides and bisimidazo perylenes in which the perylene nucleus is halogenated, preferably to an extent where 45 to 75 percent of the perylene ring hydrogens have been replaced by halogen. U.S. Pat. No. 4,587,189, the disclosure of which is totally incorporated herein by reference, illustrates layered photoresponsive imaging members prepared using highly-loaded dispersions or, preferably, vacuum evaporated thin coatings of cis- and trans-bis(benzimidazo)perylene (1, X=1,2 phenylene) and other perylenes overcoated with hole transporting compositions comprised of a variety of N,N,N',N'-tetraaryl-4,4'-diaminobiphenyls. U.S. Pat. No. 4,937,164 illustrates the use of perylene bisimides and bisimidazo pigments in which the 1,12- and/or 6,7 position of the perylene nucleus is bridged by one or 2 sulfur atoms wherein the pigments in the CGL (charge generating layer) layers are either vacuum evaporated or dispersed in binder resins in similar devices incorporating tetraaryl biphenyl hole transporting molecules.

Perylene pigments which are unsymmetrically substituted have also been selected as CGL (charge generating layers) materials in layered photoreceptors. The preparation and applications of these pigments, which can be either bis (imides) in which the imide nitrogen substituents are different or have monoimide-monoimidazo structures is described in U.S. Pat. Nos. 4,501,906; 4,709,029 and 4,714,666. U.S. Pat. No. 4,968,571 discloses unsymmetrically substituted perylenes with one phenethyl radical bonded to the imide nitrogen atom.

Two additional patents relating to the use of perylene pigments in layered photoreceptors are U.S. Pat. No. 5,019,473, which illustrates a grinding process to provide finely and uniformly dispersed perylene pigment in a polymeric binder with excellent photographic speed, and U.S. Pat. No. 5,225,307, the disclosure of which is totally incorporated herein by reference, which discloses a vacuum sublimation process which provides a photoreceptor pigment, such as bis(benzimidazo)perylene (3b, X=1,2-phenylene) with superior electrophotographic performance.

Although the known imaging members may be suitable for their intended purposes, a need remains for imaging members containing improved photogenerator compositions. In addition, a need exists for imaging members containing photoconductive components with improved xerographic electrical performance including in some instances higher charge acceptance, lower dark decay, increased charge generation efficiency and charge injection into the transporting layer, tailored PIDC curve shapes to enable a variety of reprographic applications, reduced residual charge and/or reduced erase energy, improved long term cycling performance, and less variability in performance with environmental changes in temperature and relative humidity. There is also a need for imaging members with photoconductive components comprised of certain dimmer perylene photogenerating pigment mixtures with enhanced dispersibility in polymers and solvents. Moreover, there is a need for photogenerating pigment mixtures which permit the preparation of coating dispersions, particularly in dip-coating operations, which are colloidally stable and wherein settlement is avoided or minimized, for example little settling for a period of, for example, from about 20 to about 30 days in the absence of stirring. Further, there is a need for photoconductive materials with enhanced dispersibility in polymers and solvents that enable low cost coating processes for the manufacture of photoconductive imaging members. Also, there remains a need for adjusting the physical properties of photogenerating compositions to achieve a number of desired performance requirements for photoconductors. For instance, there is a need for photoconductive materials that enable imaging members with enhanced photosensitivity in the red region of the light spectrum enabling the resulting imaging members thereof to be selected for imaging by red diode and gas lasers. Furthermore, there is a need for photogenerator pigment mixtures with spectral response in the green and blue regions of the spectrum to enable imaging by newly emerging blue and green electronic imaging light sources. A need also exists for improved panchromatic pigments with broad spectral response from about 400 to about 800 nanometers for color copying using light-lens processes.

SUMMARY OF THE INVENTION

Examples of features of the present invention include:

It is a feature of the present invention to provide photoconductive compositions comprised of mixed perylene dimers of Formulae A, B and C and electron acceptors and imaging members thereof with many of the advantages illustrated herein.

It is another feature of the present invention to provide in embodiments imaging members with improved photoconductivity.

Additionally, in another feature of the present invention there are provided perylene dimer compositions admixed with electron acceptors, and which compositions are suitable for use as photogenerator pigments in layered photoconductive imaging devices.

It is another feature of the present invention to provide photoconductive imaging members with perylene dimer photogenerating pigment mixtures that enable in embodiments imaging members with improved photosensitivity in the wavelength region of light spectrum, such as from about 400 to about 800 nanometers.

These and other features of the present invention can be accomplished in embodiments by the provision of layered imaging members comprised of a supporting substrate, a photogenerating layer comprised of a mixture of photogenerating perylenes, represented by Formulae A, B and C, and an electron acceptor.

Aspects of the present invention relate to a photoconductive imaging member comprised of a photogenerating layer comprised of a mixture of perylenes, wherein the mixture comprises (1) 1,3-bis(n-pentylimidoperyleneimido)propane (Formula A), 1,3-bis(2-methylbutylimido peryleneimido) propane (Formula B) and 1-(n-pentylimidoperyleneimido)-3-(2-methylbutylimidoperyleneimido)-propane (Formula C), and (2) an electron acceptor component Formula A 1,3-bis(n-pentylimidoperyleneimido)propane

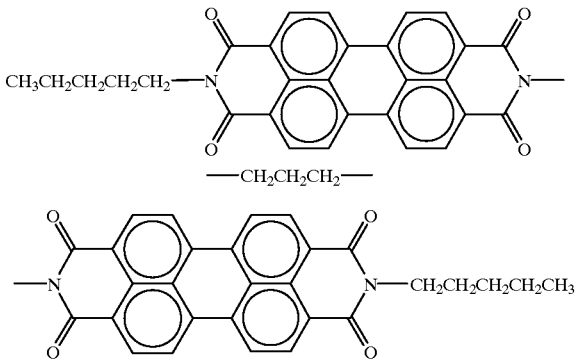

Formula B 1,3-bis(2-methylbutylimidoperyleneimido)propane

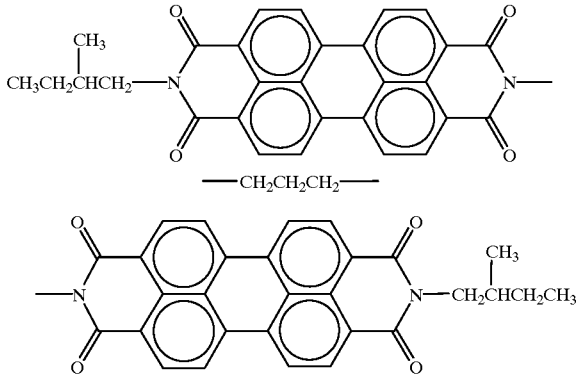

Formula C 1-(n-pentylimidoperyleneimido)-3-(2-methylbutylimidoperyleneimido)propane

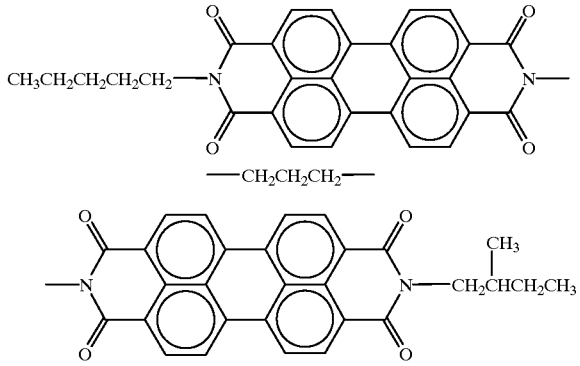

a photoconductive imaging member wherein the electron acceptor component is selected from the group consisting of carbazole, fluorenone and fluorenylidene malonitrile; a photoconductive imaging member further containing a supporting substrate, a photogenerator layer comprised of the mixture and a charge transport layer; a photoconductive imaging member wherein the relative amount of electron acceptor to the mixed perylene dimers is from about 0.1 to about 20 percent by weight; a photoconductive imaging member wherein each perylene A, B and C is present in an amount of from about 25 to about 50 weight percent, and the total amount thereof is about 100 percent; a photoconductive imaging member wherein the perylene 1,3-bis(n-pentylimidoperyleneimido)propane is present in an amount of about 25 parts or weight percent, the 1,3-bis(2-methylbutylimido peryleneimido)propane is present in an amount of about 25 parts, or weight percent and the 1-(n-pentylimidoperyleneimido)-3-(2-methylbutylimido peryleneimido)-propane is present in an amount of about 50 parts or weight percent, and wherein the total of the parts of the mixed perylene dimers is about 100 percent; a photoconductive imaging member wherein the carbazole is 9-vinylcarbazole, 9-phenylcarbazole, 9-ethylcarbazole, or 9-naphthylcarbazole; a photoconductive imaging member wherein the fluorenone is 2,4,7-trinitro-9-fluorenone, 4-n-butoxycarbonyl-9-fluorenone, 2-nitro-9-fluorenone, 2,7-dinitro-4-n-butoxycarbonyl-9-fluorenone, or 2-t-butyl-4,5,7-trinitro-9-fluorenone; a photoconductive imaging member wherein the malonitrile is 4-n-butoxycarbonyl-9-fluorenylidene malonitrile, 2,7-dinitro-9-fluorenylidene malonitrile, 2,4,7-trinitro-9-fluorenylidene malonitrile, or 2,4,5,7-tetranitro-9-fluorenylidene malonitrile; a photoconductive imaging member wherein the supporting substrate is comprised of a metal, a conductive polymer, or an insulating polymer, and wherein the substrate possesses a thickness of from about 30 microns to about 300 microns and is optionally overcoated with an electrically conductive layer with an optional thickness of from about 0.01 micron to about 1 micron; a photoconductive imaging member wherein the supporting substrate is comprised of aluminum, and there is optionally further included an overcoating top layer on the member, the overcoating being comprised of a polymer; a photoconductive imaging member wherein the photogenerating mixture is dispersed in a resinous binder in an amount of from about 5 percent to about 95 percent by weight; a photoconductive imaging member wherein the resinous binder is a polyester, a polyvinylcarbazole, a polyvinylbutyral, a polycarbonate, a polyethercarbonate, an aryl amine, a styrene copolymer, or a phenoxy polymer; a photoconductive imaging member wherein the charge transport layer is comprised of aryl amine molecules or aryl amine polymers; a photoconductive imaging member wherein the supporting substrate is comprised of a metal, a conductive polymer, or an insulating polymer, and wherein the substrate possesses a thickness of from about 30 microns to about 300 microns and is optionally overcoated with an electrically conductive layer with a thickness of from about 0.01 micron to about 1 micron; a photoconductive imaging member wherein the supporting substrate is comprised of aluminum, and there is further included an overcoating top layer on the member comprised of a polymer; a photoconductive imaging member wherein the photogenerating pigment mixture is dispersed in a resinous binder optionally in an amount of from about 5 percent to about 95 percent by weight for the mixture; a photoconductive imaging member wherein the resinous binder is a polyester, a polyvinylcarbazole, a polyvinylbutyral, a polycarbonate, a polyethercarbonate, an aryl amine, a styrene copolymer, or a phenoxy resin; a photoconductive imaging member wherein the charge transport layer is comprised of an aryl amine component; a photoconductive imaging member wherein the charge transport layer is comprised of aryl amine molecules of the formula

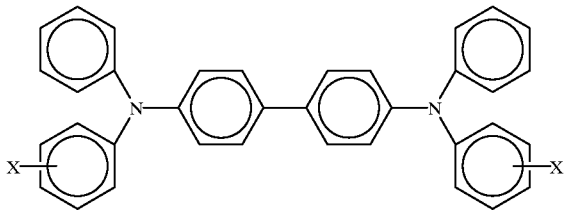

wherein X is alkyl or halogen; a photoconductive imaging member wherein the aryl amine is dispersed in a polymer of polycarbonate, a polyester, or a vinyl polymer; a photoconductive imaging member wherein the photogenerating layer is of a thickness of from about 1 to about 10 microns, and wherein the charge transport layer is of a thickness of from about 10 to about 100 microns; a photoconductive imaging member wherein the supporting substrate is overcoated with a polymeric adhesive layer of a thickness of from about 0.01 to about 1 micron; a photoconductive imaging member wherein the charge transport layer is situated between the supporting substrate and the photogenerator layer, or the photogenerating layer is situated between the supporting substrate and the charge transport layer; a photoconductive imaging method which comprises the formation of a latent image on the photoconductive imaging member the present invention, transferring the image to a substrate, and optionally fixing the image thereto; a photoconductive imaging member wherein the electron acceptor is a nonpolymer; a photoconductive imaging member wherein the malononitrile is (4-n-butoxycarbonyl-9-fluorenylidine) malononitrile; a photoconductive imaging member wherein the electron acceptor is present in an amount of from about 0.1 to about 40 weight percent; a photoconductive imaging member wherein the fluorenone is 2,4,7-trinitro-9-fluorenone; a photoconductive imaging member comprised of a photogenerating layer comprised of (1) a mixture of perylenes, and (2) an electron acceptor component; a photoconductive imaging member wherein the mixture contains from about 2 to about 6 perylene photogenerating pigments; a photoconductive imaging member wherein the binder is polyvinylbutyral and which binder contains from about 0.1 to about 15 weight percent of the electron acceptor component; a photoconductive imaging member wherein the binder is polyvinylbutyral and which binder contains from about 1 to about 10 weight percent of the electron acceptor component; an imaging member comprised of, in the order indicated, a conductive substrate, a photogenerating layer comprising a mixture of (1) perylenes and (2) an electron acceptor, optionally dispersed in a resinous binder composition, and a charge transport layer, which comprises charge transporting components optionally dispersed in an inactive resinous binder composition, and a photoconductive imaging member comprised of a conductive substrate, a hole transport layer comprising hole transport molecules, such as an aryl amine, dispersed in an inactive resinous binder composition, and as a top layer a photogenerating layer comprised of a mixture of (1) perylene dimers and (2) an electron acceptor optionally dispersed in a resinous binder composition.

The substrate can be formulated entirely of an electrically conductive material, or it can be comprised of an insulating material having an overcoat of electrically conductive material. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness. In an embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Various suitable electrically conductive materials can be selected. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from E.I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, a polyethylene terephthalate, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide, such as aluminum oxide, nickel oxide, titanium oxide, and the like. Generally, the conductive layer ranges in thickness of from about 50 Angstroms to 100 centimeters, although the thickness can be outside of this range. When a flexible electrophotographic imaging member is desired, the thickness typically is from about 100 Angstroms to about 750 Angstroms.

In embodiments, intermediate adhesive layers may be situated between the substrate and subsequently applied layers to improve adhesion and minimize or avoid peeling. When such adhesive layers are utilized, they preferably have a dry thickness of from about 0.1 micron to about 5 microns, although the thickness can be outside of this range. Typical adhesive layers include film-forming polymers such as a polyester, polyvinylbutyral, polyvinylpyrrolidone, polycarbonate, polyurethane, polymethylmethacrylate, and the like and mixtures thereof. Since the surface of the substrate can be a metal oxide layer or an adhesive layer, the expression substrate can also include a metal oxide layer with or without an adhesive layer on the metal oxide layer.

The photogenerating layer is of an effective thickness, for example, of from about 0.05 micron to about 10 microns or more, and in embodiments has a thickness of from about 0.1 micron to about 3 microns. The thickness of this layer can be dependent primarily upon the concentration of photogenerating material in the layer, which may generally vary from about 5 to about 100 percent. A 100 percent value generally occurs when the photogenerating layer is prepared by vacuum evaporation of the pigment mixture. When the photogenerating mixture is present in a binder material, the binder contains, for example, from about 25 to about 95 percent by weight of the photogenerating mixture, and more specifically, contains about 60 to about 80 percent by weight of the photogenerating material.

The resinous binder for the photogenerating mixture, when selected, can be a polyester, a polyvinylbutyral, such as PVB B79, a polycarbonate, a polyethercarbonate, an aryl amine polymer, a styrene copolymer, a phenoxy resin, and the like. The addition of a small amount, such as for example from about 0.1 to about 15 weight percent, of the electron acceptor component to the resin binder, especially PVB, can increase the photosensitivity of the imaging member. Generally, it is desirable to provide this layer in a thickness sufficient to absorb about 90 to about 95 percent or more of the incident radiation, which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired. Suitable binder materials that may be selected for the photogenerating layer, include polyesters, polyvinyl butyrals, polycarbonates, polyvinyl formals, poly (vinylacetals) and those illustrated in U.S. Pat. No. 3,121,006, the disclosure of which is totally incorporated herein by reference.

Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport components of the type described in U.S. Pat. Nos. 4,306,008; 4,304,829; 4,233,384; 4,115,116; 4,299,897; 4,081,274, and 5,139,910, the disclosures of each being totally incorporated herein by reference, can be selected for the imaging members of the present invention. Typical diamine hole transport molecules include N,N'-diphenyl-N,N'-bis(3-methylphenyl)-(1,1'-biphenyl)4,4'-diamine, N,N'-diphenyl-N,N'-bis(4-methyl phenyl)-(1,1-biphenyl)4,4'-diamine, N,N'-diphenyl-N,N'-bis(2-methylphenyl)-(1,1'-biphenyl)4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)4,4'-diamine, N,N'-diphenyl-N,N'-bis(3-chlorophenyl)-(1,1'-biphenyl)4,4'-diamine, N,N'-diphenyl-N,N'-bis(4-chlorophenyl)-(1,1'-biphenyl)4,4'-diamine, N,N'-diphenyl-N,N'-bis(phenylmethyl)-(1,1'-biphenyl)4,4'-diamine, N,N,N',N'-tetraphenyl-[2,2'-dimethyl-1,1'-biphenyl]4,4'-diamine, N,N,N', N'-tetra-(4-methylphenyl)-[2,2'-dimethyl-1,1'-biphenyl]4,4'-diamine, N,N'-diphenyl-N,N'-bis(4-methylphenyl)-[2,2'-dimethyl-1,1'-biphenyl]4,4'-diamine, N,N'-diphenyl-N,N'-bis(2-methylphenyl)-[2,2'-dimethyl-1,1'-biphenyl]4,4'-diamine, N,N'-diphenyl-N,N'-bis(3-methylphenyl)-[2,2'-dimethyl-1,1'-biphenyl]4,4'-diamine, N,N'-diphenyl-N,N'-bis(3-methylphenyl)-pyrenyl-1,6-diamine, and the like.

A specific hole transport layer, since it can enable, for example, excellent effective transport of charges, is comprised of aryldiamine components as represented, or essentially represented, by the following general formula

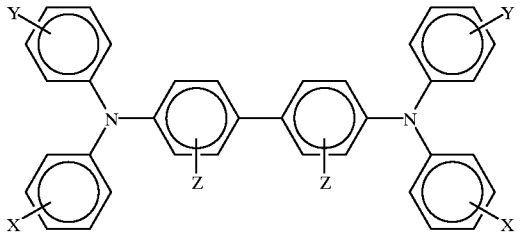

optionally dispersed in a highly insulating and transparent polymer binder, wherein X, Y and Z are selected from the group consisting of hydrogen, an alkyl group with, for example, from 1 to about 25 carbon atoms and a halogen, preferably chloro, and wherein at least one of X, Y and Z is independently an alkyl group or chloro. When Y and Z are hydrogen, the compound is N,N'-diphenyl-N,N'-bis (alkylphenyl)-(1,1'-biphenyl)4,4'-diamine wherein alkyl is, for example, methyl, ethyl, propyl, n-butyl, or the like, or the compound may be N,N'-diphenyl-N,N'-bis(chlorophenyl)-(1,1'-biphenyl)4,4'-diamine.

The charge transport component is present in the charge transport layer in an effective amount, generally from about 5 to about 90 percent by weight, preferably from about 20 to about 75 percent by weight, and more preferably from about 30 to about 60 percent by weight, although the amount can be outside of this range.

Examples of the resinous components or inactive binder resinous material for the transport layer include components, such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are in embodiments polycarbonate resins with a molecular weight ($M_w$) of from about 20,000 to about 100,000 or of from about 50,000 to about 100,000. Generally, the resinous binder contains from about 5 to about 90 percent by weight of the active material corresponding to the foregoing formula, and more specifically, from about 20 percent to about 75 percent of this material.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates, such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is preferably of a thickness of equal to or less than about 50 Angstroms to about 10 microns, and most preferably being no more than about 2 microns.

The mixed perylene dimer comprised of Formulae A, B and C of the present invention can be readily prepared as illustrated in U.S. Pat. No. 5,645,965, the disclosure of which is totally incorporated herein by reference. More specifically, the mixed perylene dimer can be prepared by the reaction, or condensation of about 2 to about 5 equivalents of mixed perylene monoimide-monoanhydride (Formula D)

FORMULA D

Mixed perylene monoimide-Monoanhydride

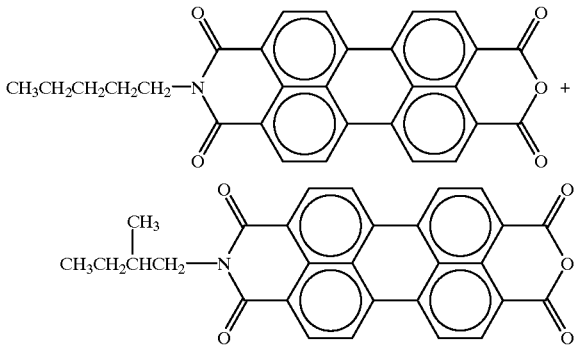

with one equivalent of diamine, 1,3-diaminopropane, in an organic solvent, such as chloronaphthalene, trichlorobenzene, decalin, tetralin, aniline, dimethylformamide, dimethylsulfoxide, N-methylpyrrolidone and the like with the optional use of catalysts, such as zinc acetate or zinc iodide, in an amount equivalent to about 1 to about 50 mole percent of the perylene. The concentration of reactants in the solvent can range from about 50 weight percent combined diamine and anhydride and about 50 percent solvent to about 2 percent diamine and anhydride and about 98 percent solvent with a more specific range being from about 5 percent diamine and anhydride and about 95 percent solvent to about 20 percent diamine and anhydride and about 80 percent solvent. The reactants can be stirred in the solvent and heated to a temperature of from about 100°C. to about 300° C., and preferably from about 150° C. to about 205° C. for a period of from about 10 minutes to about 8 hours depending on the rate of the reaction. The resulting mixture is subsequently cooled to a temperature of between about 50° C. to about 175° C., and the solid pigment mixture is separated from the mother liquor by filtration through, for example, a fine porosity sintered glass filter funnel or a glass fiber filter. The pigment product is then subjected to a number of washing steps using hot and cold solvents, such as dimethyl formamide, methanol, water and alcohols. Optionally, the pigment may be washed with a dilute hot or cold aqueous base solution, such as 5 percent of sodium hydroxide or potassium carbonate, which serves to remove by dissolution any residual starting anhydride and other acidic contaminants. Also, optionally, the pigment product may also be washed with dilute acid, such as 2 percent aqueous hydrochloric acid, which serves to remove residual metal salts, such as, for example, zinc acetate which can be optionally used as a reaction catalyst. The pigment is then dried either at ambient temperature or at temperatures up to about 200° C. at atmospheric pressure or under a vacuum. The yield of the mixed perylene dimer product ranges from about 50 percent to about 100 percent.

More specifically, the process comprises stirring a mixture of 2.2 molar equivalents of mixed perylene monoimide-monoanhydride (Formula D) in a suitable solvent, such as a N-methylpyrrolidone solvent in an amount corresponding to about 50 parts by weight of solvent to about 2 parts of monoimide-monoanhydrides at room temperature, about 25° C., followed by adding 1 molar equivalent of 1,3-diaminopropane and, optionally, a catalyst primarily increases the reaction of the amine with the anhydride, such catalysts, including zinc acetate dihydrate in an amount corresponding to about 0.5 equivalent. The resulting mixture is stirred and heating is accomplished until the solvent begins to reflux (N-methylpyrrolidone boils at 202° C.) during which treatment the diamine reacts sequentially with two molecules of the monoanhydride to form the dimeric perylene pigment molecule. The heating and stirring at the solvent reflux temperature is maintained for a period of about 2 hours to ensure completion of the reaction, followed by cooling the reaction mixture to about 150° C. and filtering the mixture through a filter, such as fine-porosity sintered glass of a glass-fiber filter, which has been preheated to about 150° C. with, for example, a boiling solvent such as dimethylformamide (DMF). Washing the pigment is then accomplished in the filter with DMF heated to about 150° C. (which serves to dissolve and thus remove any residual starting anhydride) until the color of the filtrate wash becomes, and remains colorless or light orange. The pigment mixture is washed with DMF at room temperature and is finally washed with acetone, methanol or a similar low-boiling solvent and is dried at 60° C. in an oven.

Optionally, water can be used in the final washing and the pigment mixture wet cake can be freeze dried. This process generally provides a free-flowing pigment mixture, which is more readily redispersed in solvent than solvent washed pigment, which has been dried using other methods which can sometimes result in the formation of a hard, caked mass of a pigment mixture, which can be difficult to redisperse.

Also optionally, in situations where the hot, for example about 60° C. to about 150° C., solvent (e.g. DMF) fails to completely remove all the excess starting monoanhydride the product mixture can be dispersed in dilute (for example 1 to about 5 percent) aqueous potassium hydroxide for a period of time of from about 1 hour to about 24 hours, and preferably from about 7 to about 20 hours, at temperature of from about 25° C. to about 90° C., which treatment converts the monoimide to a water-soluble, deep purple-colored dipotassium carboxylate salt, followed by filtration and washing the solid with water until the filtrate is colorless. Residual starting anhydride in the product can be detected by known spectroscopic methods, such as FT-IR and NMR, or by a color spot test in which the product is stirred in dilute, (about 2 percent) aqueous potassium hydroxide solution (the presence of monoanhydride is indicated by the development of a deep reddish purple color characteristic of the dipotassium salt of the monoimide).

The perylene dimer compositions illustrated herein in embodiments thereof enable enhanced photosensitivity in the visible wavelength range. In particular, imaging members with photosensitivity at wavelengths of from about 400 to about 800 nanometers are provided in embodiments of the present invention, which renders them particularly useful for color copying and imaging and printing applications, such as red LED and diode laser printing processes, which typically require sensitivity from about 600 to about 80 nanometers.

The present invention thus encompasses a method of generating images with the photoconductive imaging members disclosed herein. The method comprises generating an electrostatic latent image on a photoconductive imaging member of the present invention, developing the latent image with a known toner comprised of resin, colorant like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. Fixing may be performed by means of any suitable method, such as flash fusing, heat fusing, pressure fusing, vapor fusing, and the like. Any material used in xerographic copiers and printers may be used as a substrate, such as paper, transparency material, or the like.

The PMMA-BCFM polymer recited herein is of the formula

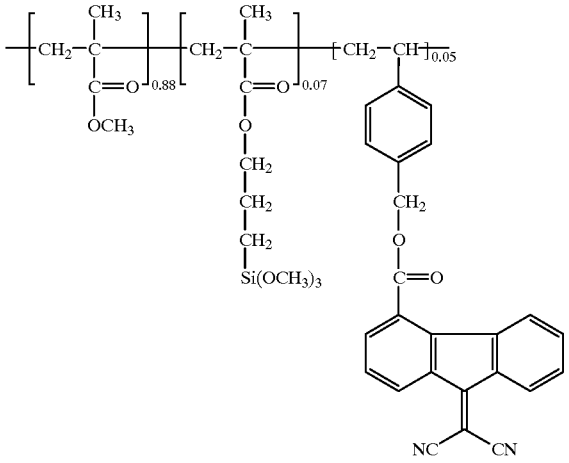

The following Examples are provided, which Examples are intended to be illustrative, and the invention is not limited to the materials, conditions, or process parameters set forth in these embodiments. All parts and percentages are by weight unless otherwise indicated.

SYNTHESIS EXAMPLE I

Preparation of Mixed Perylene:

In a 3 liter, 3-neck round-bottom flask, fitted with a mechanical agitator, a reflux condenser, a Dean-Stark trap, and a thermometer, a suspension of the mixed isomer n-pentylimidoperylene monoanhydride and 2-methylbutylimidoperylene monoanhydride (51.05 grams, 0.1106 mole) in 1,250 grams of N-methylpyrrolidinone (NMP) were treated with 4 grams (0.054 mole) of 1,3-propanediamine. The resulting mixture was then stirred and was heated (under a nitrogen atmosphere) to 200° C. for 4.5 hours. The resulting thick dark brown-black mixture was cooled to 90° C. then was vacuum filtered through a 12.5 centimeter preheated (in an oven at 100° C.) Buckner funnel fitted with a glass fiber filter media (#30 grade Schleicher and Schnell) to separate the product.

The retained solid product was placed in a 2 liter beaker with 500 grams of N,N-dimethylformamide (DMF) solvent. A 3 inch magnetic stir bar was added and the mixture was stirred with heating to 90° C. for 60 minutes. The mixture was filtered using a preheated 12.5 centimeter Buckner funnel (fitted with #30 glass fiber filter media) to isolate the product. This washing procedure was repeated 8 times until the color of the wash filtrate was clear in color. The solid was then washed three times with 500 grams of methanol heated to 50° C. for 30 minutes, followed by vacuum filtration, as above. The dark brown-black solid of mixed perylene dimer was dried at 70° C. for 20 hours to provide 46.7 grams (typical yield of 90 to 95 percent) of solid product. The resulting product mixed perylene dimers were identified by proton nuclear magnetic resonance spectroscopy as a mixture of the three dimers corresponding to the above Formulae A, B and C in a ratio of about 1:1:2, respectively.

DEVICE EXAMPLE I

Xerographic Evaluation of Perylene Dimer Compositions Containing an Electron Transport Dopant:

Photoresponsive imaging members were fabricated with the mixed perylene dimer A, B and C of Synthesis Example I and different electron acceptor dopant materials listed in Table A to form the photogenerator layer. The photogenerator layer contained about 81.5 weight percent of the perylene pigment mixture, 18.5 weight percent of polyvinylbutyral polymer binder (PVB, available from Monsanto as B79) and of the 81.5 percent, the perylene mixture containing the above three perylenes was present in an amount of about 74.1 weight percent, and the dopant was present in the mixture in an amount of about 7.4 weight percent. The relative weight ratio of dopant to the perylene mixture was 1:10.

The photogenerator layer thus contained about 18.5 weight percent or parts of PVB and about 81.5 weight percent of perylene mixture containing the three perylene dimers and dopant. Of this 81.5 percent, the mixed perylene dimers accounted for about 74.1 percent and the dopant for about 7.4 percent.

TABLE A

| IMAGING MEMBER ID | DOPANT USED |
|---|---|
| 1A | None |
| 1B | N,N'-diphenyl-N,N'-bis(3-methylphenyl)-(1,1'-biphenyl)-4,4'-diamine |
| 1C | N,N-bis(3,4-dimethylphenyl)biphenyl-4-amine |
| 1D | Tritolylamine |
| 1E | 9-vinylcarbazole |
| 1F | 4-n-butoxycarbonyl-9-fluorenylidene malonitrile |
| 1G | 2,4,7-trinitro-9-fluorenone |

The photoresponsive imaging members generally known as dual layer photoreceptors contain a photogenerator layer, and thereover a charge transport layer. The photogenerator layer was prepared from a pigment dispersion as follows: 0.2 gram of the above A, B, C mixed perylene dimer, 0.02 gram of the dopant, 0.05 gram of polyvinylbutyral (PVB) polymer, 3.5 grams of tetrahydrofuran (THF), and 3.5 grams of toluene were added to a 30 milliliter glass bottle containing 70 grams of ⅛-inch stainless steel balls. The bottle was placed on a roller mill, and the resulting dispersion was milled for 4 days. For reference purpose, a control dispersion was also prepared with the above component, but excluding the dopant.

Using a film applicator of 1 mil gap, the pigment dispersion was coated to form the photogenerator layer on a titanized MYLAR® substrate of 75 microns in thickness, which had a silane layer, 0.1 micron in thickness, thereover, and E.I. DuPont 49,000 polyester adhesive on the silane layer in a thickness of 0.1 micron. Thereafter, the photogenerator layer formed was allowed to dry in air for about 10 minutes. The photogenerator layer contained about 18.5 weight percent of the perylene pigment mixture present in an amount of 74.1 weight percent, and the dopant was present in an amount of about 7.4 weight percent.

The above perylene photogenerator layer for each device was overcoated with an amine charge transport layer prepared as follows. A transport layer solution was prepared by mixing 6.3 grams of MAKROLON®, a polycarbonate resin, 6.3 grams of N,N'-diphenyl-N,N'-bis (3-methylphenyl)-(1,1'-biphenyl)4,4'-diamine and 72 grams of methylene chloride. The solution was coated onto the above photogenerating layer using a film applicator of 10 mil gap. The resulting member was dried at 115° C. in a forced air oven for 60 minutes and the final dried thickness of transport layer was about 25 microns.

The xerographic electrical properties of each imaging member were then determined by electrostatically charging its surface with a corona discharging device until the surface potential, as measured by a capacitively coupled probe attached to an electrometer, attained an initial value $V_0$. After resting for 0.5 second in the dark, the charged member reached a surface potential of $V_{ddp}$, dark development potential, and was then exposed to light from a filtered xenon lamp. A reduction in the surface potential to $V_{bg}$, background potential due to photodischarge effect, was observed. Usually the dark decay in volt/second was calculated as $(V_0-V_{ddp})/0.5$. The lower the dark decay value, the more favorable is the ability of the member to retain its charge prior to exposure by light. Similarly, the lower the $V_{ddp}$, the poorer is the charging behavior of the member. The percent photodischarge was calculated as 100 percent× $(V_{ddp}-V_{bg})V_{ddp}$. The light energy used to photodischarge the imaging member during the exposure step was measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. Higher photosensitivity (lower $E_{1/2}$ value), lower dark decay and high charging are desired for the improved performance of xerographic imaging members.

The following Table 1 summarizes the xerographic electrical results when the exposed light used was at a wavelength of 620 nanometers.

TABLE 1

| Imaging Member ID | Composition of Photogenerating Layer | Dark Decay V/s | $E_{½}$ Erg/cm$^2$ |
|---|---|---|---|
| 1A | 81.5 weight percent perylene in PVB | 11.7 | 3.04 |
| 1B | 81.5 weight percent (10:1 perylene/N,N'-diphenyl-N,N'-bis(3-methylphenyl)-(1,1'-biphenyl)-4,4'-diamine) in PVB | 14.4 | 3.02 |
| 1C | 81.5 weight percent (10:1 perylene/N,N-bis(3,4-dimethylphenyl)biphenyl-4-amine) in PVB | 10.2 | 2.99 |
| 1D | 81.5 weight percent (10:1 perylene/tritolylamine) in PVB | 13.0 | 3.04 |
| 1E | 81.5 weight percent (10:1 perylene/9-vinylcarbazole) in PVB | 26.9 | 2.71 |
| 1F | 81.5 weight percent (10:1 perylene /4-n-butoxycarbonyl-9-fluorenylidene malonitrile) in PVB | 20.7 | 2.47 |
| 1G | 81.5 weight percent (10:1 perylene /2,4,7-trinitro-9-fluorenone) in PVB | 23.8 | 2.87 |

With respect to the control member 1A, which contains only perylene and PVB, all devices 1E, 1F and 1G containing the electron acceptor dopants showed lower half-exposure energy $E_{1/2}$ and hence higher photosensitivity. Devices 1B, 1C and 1D containing electron donor dopants showed little or no change in half-exposure energy. This demonstrates these electron acceptor dopants are useful in improving the photosensitivity of the mixed perylene dimer.

In the Table, perylene refers to a mixture of A, B and C perylenes of Synthesis Example I above.

DEVICE EXAMPLE II

Xerographic Evaluation of Perylene Dimer Mixture Containing Carbazole Dopants:

Photoresponsive imaging members of the perylene dimer mixture containing different kinds of carbazole molecules as a dopant were fabricated in accordance with the procedure of Device Example I except that photogenerator layers contained 42 weight percent of PVB and 58 weight percent of the perylene mixed pigment and dopant. The photogenerator layer was prepared from a pigment dispersion of 0.2 gram of the above prepared mixed perylene dimer, 0.02 gram of dopant material, 0.3 gram of polyvinylbutyral (PVB) polymer, 3.5 grams of tetrahydrofuran (THF), and 3.5 grams of toluene. The dopants were as indicated and the xerographic electrical results obtained for the resulting imaging members studied are provided in Table 2.

TABLE 2

| Imaging Member ID | Composition of Photogenerating Layer | Dark Decay V/s | $E_{1/2}$ Erg/cm$^2$ |
|---|---|---|---|
| 2A | 58 weight percent perylene in PVB | 7.8 | 3.5 |
| 2B | 58 weight percent (10:1 perylene /9-vinylcarbazole) in PVB | 7.3 | 2.53 |
| 2C | 58 weight percent (10:1 perylene /9-phenylcarbazole) in PVB | 8.0 | 2.62 |
| 2D | 58 weight percent (10:1 perylene /9-ethylcarbazole) in PVB | 8.0 | 2.57 |
| 2E | 58 weight percent (10:1 perylene /9-naphthylcarbazole) in PVB | 10.8 | 2.66 |
| 2F | 58 weight percent (10:1 perylene /polyvinylcarbazole) in PVB | 36.2 | 2.23 |

The results in Table 2 indicate that carbazole dopants generally improve the photosensitivity (i.e. reduced $E_{1/2}$ value) of the perylene dimer photogenerator mixture layer.

DEVICE EXAMPLE III

Photosensitivity Concentration of Polyvinycarbazole Dopant:

Primarily to determine the influence of the concentration of the polyvinylcarbazole (PVK) on xerographic performance, a series of photoresponsive imaging members incorporating different amounts of dopant were fabricated as illustrated in Device Example II. The amount of mixed perylene dimer was kept constant at 0.2 gram. The weight ratio of perylene to PVK varied from 100:1 to 100:10. The composition of the photogenerating layer and corresponding xerographic electricals are shown in Table 3.

TABLE 3

| Imaging Member ID | Composition of Photogenerating Layer | Dark Decay V/s | $E_{1/2}$ Erg/cm$^2$ |
|---|---|---|---|
| 3A | 58 weight percent perylene in PVB | 7.8 | 3.5 |
| 3B | 58 weight percent (100:1 perylene/PVK) in PVB | 13.6 | 3.09 |
| 3C | 58 weight percent (100:2 perylene/PVK) in PVB | 15.3 | 2.88 |
| 3D | 58 weight percent (100:5 perylene/PVK in PVB | 16.3 | 2.56 |
| 3E | 58 weight percent (100:10 perylene/PVK) in PVB | 36 | 2.23 |

The photosensitivity of perylene dimer increased (i.e. half-exposure energy $E_{1/2}$ decreases) with increasing amount of polyvinylcarbazole dopant added to the photogenerator layer. There was some increase in dark decay, but the value remains reasonable for practical applications even at the highest doping level used.

Imaging members as illustrated above with an electron acceptor polymer of PMMA-BCFM exhibited the following results.

TABLE 4

Xerographic Electricals of 80 weight percent 535+ in PMMA-BCFM

| CGL | D.D. V/.5s | $E_{1/2}$ erg/cm$^2$ | $E_{7/8}$ erg/cm$^2$ | Vr, V |
|---|---|---|---|---|
| 80 weight percent 535+/4.5 mol percent PMMA-BCFM | 15.4 | 2.45 | 5.03 | 1 |

TABLE 4-continued

Xerographic Electricals of 80 weight percent 535+ in PMMA-BCFM

| CGL | D.D. V/.5s | $E_{1/2}$ erg/cm$^2$ | $E_{7/8}$ erg/cm$^2$ | Vr, V |
|---|---|---|---|---|
| 80 weight percent 535+/10 mol percent PMMA-BCFM | 30.5 | 2.39 | 4.75 | 2 |

Other embodiments and modifications of the present invention may occur to those skilled in the art subsequent to a review of the information presented herein; these embodiments modifications, and equivalents thereof, are also included within the scope of this invention.

What is claimed is:

1. A photoconductive imaging member comprised of a photogenerating layer comprised of a mixture of (1) 1,3-bis (n-pentylimidoperyleneimido)propane (Formula A), 1,3-bis (2-methylbutylimido peryleneimido)propane (Formula B) and 1-(n-pentylimidoperyleneimido)-3-(2-methylbutylimidoperyleneimido)-propane (Formula C), and (2) an electron acceptor component Formula A 1,3-bis(n-pentylimidoperyleneimido)propane

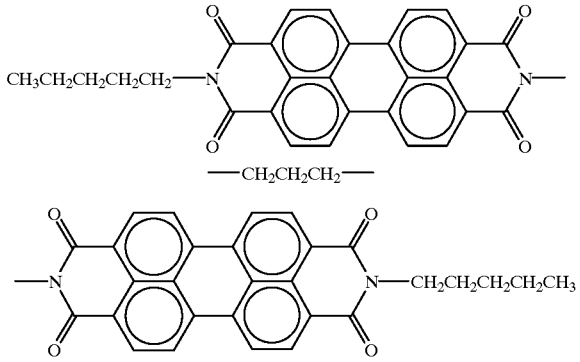

Formula B 1,3-bis(2-methylbutylimidoperyleneimido)propane

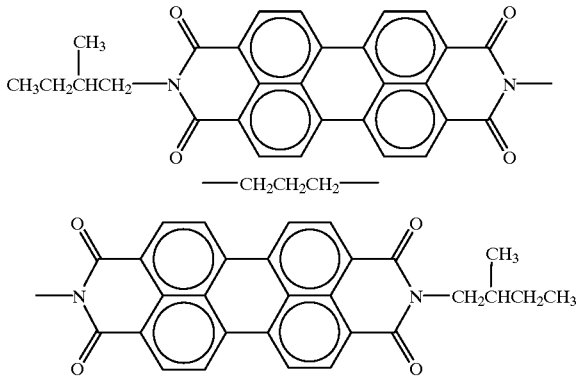

Formula C 1-(n-pentylimidoperyleneimido)-3-(2-methylbutylimidoperyleneimido)propane

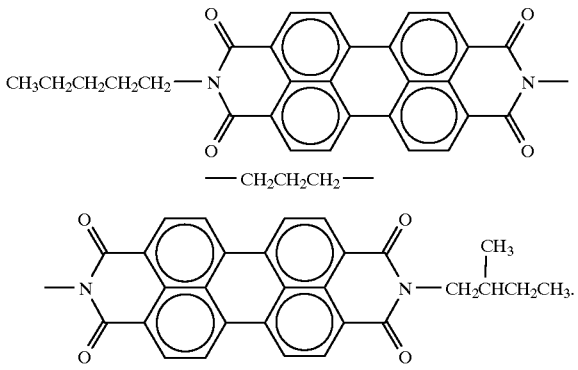

2. A photoconductive imaging member in accordance with claim 1 wherein the electron acceptor component is selected from the group consisting of carbazole, fluorenone and fluorenylidene malonitrile.

3. A photoconductive imaging member in accordance with claim 1 further containing a supporting substrate, a photogenerator layer comprised of said mixture and a charge transport layer.

4. A photoconductive imaging member in accordance with claim 1 wherein the relative amount of electron acceptor to the mixed perylene dimers is from about 0.1 to about 20 percent by weight.

5. A photoconductive imaging member in accordance with claim 1 wherein each perylene A, B and C is present in an amount of from about 25 to about 50 weight percent, and the total amount thereof is about 100 percent.

6. A photoconductive imaging member in accordance with claim 1 wherein the perylene 1,3-bis(n-pentylimidoperyleneimido)propane is present in an amount of about 25 parts or weight percent, the 1,3-bis(2-methylbutylimido peryleneimido)propane is present in an amount of about 25 parts, or weight percent and the 1-(n-pentylimidoperyleneimido)-3-(2-methylbutylimido peryleneimido)-propane is present in an amount of about 50 parts or weight percent, and wherein the total of said parts of said mixed perylene dimers is about 100 percent.

7. A photoconductive imaging member in accordance with claim 2 wherein said carbazole is 9-vinylcarbazole, 9-phenylcarbazole, 9-ethylcarbazole, or 9-naphthylcarbazole.

8. A photoconductive imaging member in accordance with claim 2 wherein said fluorenone is 2,4,7-trinitro-9-fluorenone, 4-n-butoxycarbonyl-9-fluorenone, 2-nitro-9-fluorenone, 2,7-dinitro-4-n-butoxycarbonyl-9-fluorenone, or 2-t-butyl-4,5,7-trinitro-9-fluorenone.

9. A photoconductive imaging member in accordance with claim 2 wherein said malonitrile is 4-n-butoxycarbonyl-9-fluorenylidene malonitrile, 2,7-dinitro-9-fluorenylidene malonitrile, 2,4,7-trinitro-9-fluorenylidene malonitrile, or 2,4,5,7-tetranitro-9-fluorenylidene malonitrile.

10. A photoconductive imaging member in accordance with claim 3 wherein the supporting substrate is comprised of a metal, a conductive polymer, or an insulating polymer, and wherein said substrate possesses a thickness of from about 30 microns to about 300 microns and is optionally overcoated with an electrically conductive layer with an optional thickness of from about 0.01 micron to about 1 micron.

11. A photoconductive imaging member in accordance with claim 3 wherein the supporting substrate is comprised of aluminum, and there is optionally further included an overcoating top layer on said member, said overcoating being comprised of a polymer.

12. A photoconductive imaging member in accordance with claim 1 wherein the photogenerating mixture is dispersed in a resinous binder in an amount of from about 5 percent to about 95 percent by weight.

13. A photoconductive imaging member in accordance with claim 12 wherein the resinous binder is a polyester, a polyvinylcarbazole, a polyvinylbutyral, a polycarbonate, a polyethercarbonate, an aryl amine, a styrene copolymer, or a phenoxy polymer.

14. A photoconductive imaging member in accordance with claim 3 wherein the charge transport layer is comprised of aryl amine molecules or aryl amine polymers.

15. A photoconductive imaging member in accordance with claim 3 wherein the supporting substrate is comprised of a metal, a conductive polymer, or an insulating polymer, and wherein said substrate possesses a thickness of from about 30 microns to about 300 microns and is optionally overcoated with an electrically conductive layer with a thickness of from about 0.01 micron to about 1 micron.

16. A photoconductive imaging member in accordance with claim 3 wherein the supporting substrate is comprised of aluminum, and there is further included an overcoating top layer on said member comprised of a polymer.

17. A photoconductive imaging member in accordance with claim 1 wherein the photogenerating pigment mixture is dispersed in a resinous binder optionally in an amount of from about 5 percent to about 95 percent by weight for said mixture.

18. A photoconductive imaging member in accordance with claim 17 wherein the resinous binder is a polyester, a polyvinylcarbazole, a polyvinylbutyral, a polycarbonate, a polyethercarbonate, an aryl amine, a styrene copolymer, or a phenoxy resin.

19. A photoconductive imaging member in accordance with claim 3 wherein the charge transport layer is comprised of an aryl amine component.

20. A photoconductive imaging member in accordance with claim 3 wherein the charge transport layer is comprised of aryl amine molecules of the formula

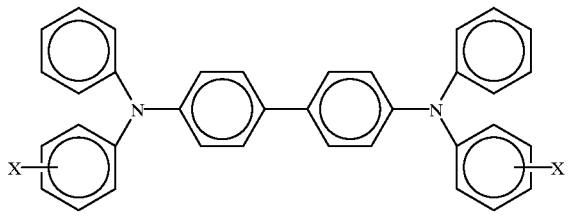

wherein X is alkyl or halogen.

21. A photoconductive imaging member in accordance with claim 20 wherein the aryl amine is dispersed in a polymer of polycarbonate, a polyester, or a vinyl polymer.

22. A photoconductive imaging member in accordance with claim 3 wherein the photogenerating layer is of a thickness of from about 1 to about 10 microns, and wherein the charge transport layer is of a thickness of from about 10 to about 100 microns.

23. A photoconductive imaging member in accordance with claim 3 wherein the supporting substrate is overcoated with a polymeric adhesive layer of a thickness of from about 0.01 to about 1 micron.

24. A photoconductive imaging member in accordance with claim 3 wherein the charge transport layer is situated between the supporting substrate and the photogenerator layer, or the photogenerating layer is situated between the supporting substrate and the charge transport layer.

25. A photoconductive imaging method which comprises the formation of a latent image on the photoconductive imaging member of claim 3, transferring the image to a substrate, and optionally fixing the image thereto.

26. A photoconductive imaging member in accordance with claim 1 wherein said electron acceptor is a nonpolymer.

27. A photoconductive imaging member in accordance with claim 2 wherein said malononitrile is (4-n-butoxycarbonyl-9-fluorenylidine) malononitrile.

28. A photoconductive imaging member in accordance with claim 1 wherein said electron acceptor is present in an amount of from about 0.1 to about 40 weight percent.

29. A photoconductive imaging member in accordance with claim 2 wherein said fluorenone is 2,4,7-trinitro-9-fluorenone.

30. A photoconductive imaging member in accordance with claim 12 wherein said binder is polyvinylbutyral and which binder contains from about 0.1 to about 15 weight percent of said electron acceptor component.

31. A photoconductive imaging member in accordance with claim 12 wherein said binder is polyvinylbutyral and which binder contains from about 1 to about 10 weight percent of said electron acceptor component.

* * * * *